United States Patent [19]

Willem

[11] 4,114,676

[45] Sep. 19, 1978

[54] METHOD FOR FIXING A METALLIC ARMATURE ON A NON-METALLIC PART

[75] Inventor: Michel Willem, Cusset, France

[73] Assignee: Ceraver S.A., Paris, France

[21] Appl. No.: 665,219

[22] Filed: Mar. 9, 1976

Related U.S. Application Data

[63] Continuation-in-part of Ser. No. 423,825, Dec. 11, 1973, Pat. No. 3,964,536.

[30] Foreign Application Priority Data

Dec. 12, 1972 [FR] France ..... 72 44170

[51] Int. Cl.[2] ..... B22D 19/12

[52] U.S. Cl. ..... 164/108; 164/10; 164/98

[58] Field of Search ..... 164/98, 99, 100, 101, 164/75, 107, 108, 111, 9, 10, 11, 110; 228/122, 123, 214; 29/631

[56] References Cited

U.S. PATENT DOCUMENTS 2,094,287 9/1937 Zimmerman et al. ..... 164/111 X

FOREIGN PATENT DOCUMENTS 448,956 9/1927 Fed. Rep. of Germany.
456,051 2/1928 Fed. Rep. of Germany.
378,474 7/1923 Fed. Rep. of Germany.
310,222 4/1929 United Kingdom.
347,930 5/1931 United Kingdom.
953,578 3/1964 United Kingdom.

*Primary Examiner*—Francis S. Husar
*Assistant Examiner*—Gus T. Hampilos
*Attorney, Agent, or Firm*—Sughrue, Rothwell, Mion, Zinn and Macpeak

[57] ABSTRACT

Method for fixing a connecting cap (4) on a non-metallic part (1) by molding of the metal or alloy of the connecting cap in the melted state on the outer surface of the non-metallic part. One or several metallic parts closely applied more particularly a sleeve (2) or a ring, is arranged at least on a part of that outer surface.

1 Claim, 5 Drawing Figures

METHOD FOR FIXING A METALLIC ARMATURE ON A NON-METALLIC PART

CROSS REFERENCE TO RELATED APPLICATION

This is a continuation-in-part of Ser. No. 423,825 filed Dec. 11, 1973 which is now U.S. Pat. No. 3,964,536.

The present invention concerns a method for fixing a metallic connecting cap on a non-metallic dielectric part by molding the metal or alloy of the connecting cap in the melted state on the adherence bearing surface of the non-metallic part. The non-metallic part may be, for example, an insulating part made of a ceramic substance: glass, porcelain, etc., of an electric insulator. It concerns also a device for implementing that method and the objects produced by that method.

A known method was the object of French Pat. No. 1,253,881 of Jan. 5, 1960, for the manufacturing of suspension insulators. The technological difficulties have, however, been such that it does not seem that industrial production has been developed, except by the assignee of the applicant, which has commercialized on a large scale a production of suspension insulators of the cap and rod type whose insulating part is a tempered glass plate provided with an adherence bearing surface on which is molded directly a cap made of a zinc, aluminum, and magnesium alloy whose melting temperature is close to 380° C, such as that sold under the trademark "Zamak".

British Pat. No. 310.222 discloses a method of casting a filling of a low-melting metal such as a hard lead alloy between an insulator head and a preformed metal cap, after applying by spraying or pouring a very thin intermediate layer, either non-metallic or of a very soft metal, around the insulator head, in order to protect the insulator head against detrimental stresses due to the contraction of the filling on cooling. The problem of avoiding excessive thermal gradients on the insulator head during the casting operation is of no practical importance in that method since the cold metal cap provides a large heat sink for the relatively small amount of metal of the filling, which is moreover at a relatively low temperature.

On the contrary, when the cap itself is to be cast on the insulator head, the problem of avoiding excessive thermal gradients on the insulator head during the casting is very serious, especially when the cap is cast by injection molding. This is so because there is little heat sink provided by the mold, which must be preheated in order to prevent immediate solidification of the cast metal on its contact with the mold, preventing the manufacture of satisfactory caps, and because the amount of cast metal is much larger and its temperature much higher, about 500° C to 700° C and for instance of about 650° C for aluminum alloys.

Despite particular precautions, such as the coating of the adherence bearing surface with a layer of heat insulating substance previous to the molding, the methods disclosed in the above patents have not enabled up till now the fixing of the metallic connecting cap on a non-metallic part when the metal or alloy had a relatively high melting point, from 500° to 700° C, for example about 650° C or more, especially when the non-metallic part was made of a substance sensitive to heat shocks, such as tempered or non-tempered glass, electrotechnical porcelain, ceramic oxide or compound substance, etc.

The aim of the present invention is to overcome the limitations of the above method and to enable the fixing of a metallic connecting cap on a non-metallic dielectric part which may be of very diverse nature and even sensitive to heat shocks by implementing metals or alloys melting at a relatively high temperature. However, it also applies in the case of alloys melting at lower temperatures and confers thereon a greater ease of production.

The method according to the invention is characterized in that one or several thin metallic parts are arranged closely applied on a part of the outer surface of the non-metallic dielectric part.

It comprises, moreover, preferably at least one of the following characteristics:

The metallic part is in the form of a metal sleeve made of a metal which is a good conductor of heat, crimped on the outer surface; of the non-metallic dielectric part;

The metallic part is in the form of a ring;

A sleeve and a ring are arranged simultaneously on the outer surface; of the non-metallic dielectric part.

The ring is constituted by the same metal or alloy as that of the connecting cap;

The ring fulfills the function of a seal between the mold and the non-metallic part, thus limiting the molding volume;

The ring is itself formed by molding, previously to the molding of the connecting cap;

The ring is molded at the same time as the connecting cap of a non-metallic part, then separated from the latter and arranged on a non-metallic part for a subsequent molding operation;

The edge of the sleeve is in the form of a flange intended for forming the seal between the mold and the non-metallic part;

The sleeve is applied to the outer surface of the non-metallic dielectric part by the molding pressure.

The device according to the invention is characterized in that it comprises a mold covering the outer surface of the non-metallic dielectric part, that outer surface constituting a core of the mold, a seal between that outer surface and the mold limiting the molding volume, and one or more metallic parts closely applied at least to one part of the outer surface. Preferably, the mold comprises two cavities, the one corresponding to the volume of the connecting cap to be fixed, the other corresponding to that of a ring intended for forming a seal between the mold and the outer surface of the non-metallic dielectric part.

Various fixing means for metallic armatures on electric insulators are described herebelow, by way of examples and with reference to the accompanying drawing.

The FIG. 1 shows an axial cross-section view of a cap and rod type insulator, in which a metallic sleeve is arranged on the insulator head.

Figure 1:
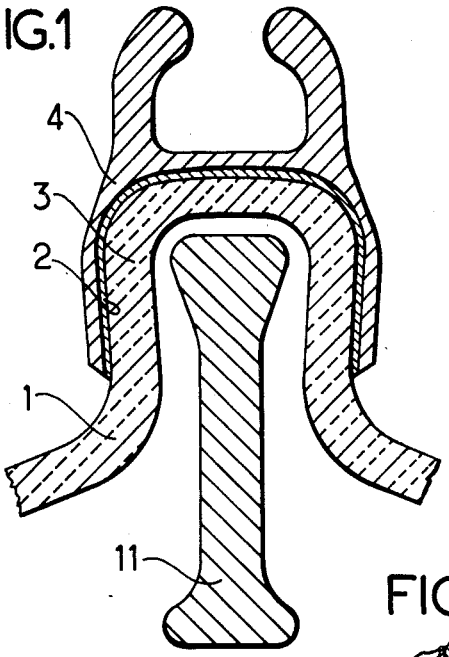

The insulator shown in FIG. 1 is constituted by a body 1 made of ceramic (tempered glass, for example) arranged on the head of a rod 11. A thin metallic sleeve 2 and which may easily be deformed, crimped closely to the head 3 of the plate by electromagnetic pressing or any other equivalent means, is arranged on the body 1.

The body 1 fitted with the sleeve 2 is inserted in a mold (not shown) providing, between the inner walls of the mold, the outer surface of the sleeve 2, and a seal between the mold and the body 1, a volume corresponding to the cap 4 obtained by molding under pressure the melted metal or alloy in the volume previously defined. The sleeve 2 prevents the direct arrival of the melting mass onto the ceramic substance and consequently reduces the thermal shock, which is particularly dangerous at the point where the cast metal reaches, in the first place, the ceramic substance. The metallic sleeve 2 in contact with the cast metal jet heats up, but distributes, by its good conductivity, that heating throughout the whole surface of the head 3 and damps the local thermal stresses. During the cooling of the melted mass, the shrinkage phenomenon causes compression effects in the head 3. These compression effects are generally favorable, on condition that they be maintained within controlled limits. The presence of the sleeve 2, whose nature and dimensions may be modified, makes that controlling easier.

The absence of adherence between the sleeve 2 and the head 3 makes easier the relative sliding and avoids localized tearing effects. The possibility of sliding of the sleeve 2, more particularly in the zone 5 corresponding to the edge of the cap 4, enables a certain flowage of the substance of the sleeve 2 and contributes to providing in that zone a moderate compression gradient between the highly stressed part of the head 3 and the part of the body 1 which is not affected.

Just as it is recommended to provide, in the zone 5, a moderate mechanical stress gradient, it is also recommended to provide, during the molding, a moderate temperature gradient in that same zone between the head heated by the melting mass and the flat non-heated part of the body 1. It is naturally possible to decrease the difference in temperature between these two parts by a previous heating of the plate. Nevertheless, it is impossible to bring the temperature of the remainder of the body to the same temperature as that of the head. To produce this moderate temperature gradient, a metallic part, fulfilling the function of a heat absorber and a radiator, is arranged in that zone.

Figure 2:
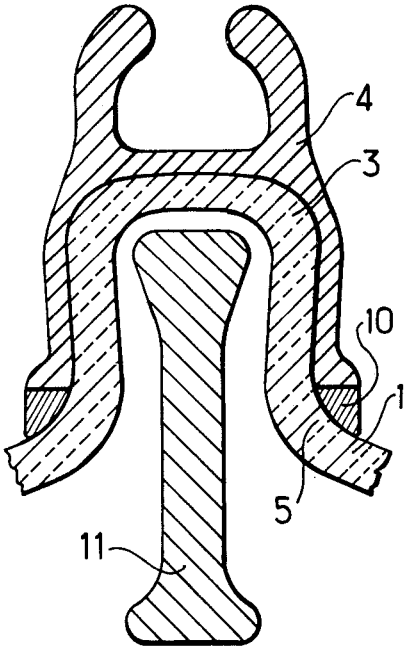
FIG. 2 shows an axial cross-section view of a cap and rod type insulator, in which a metallic ring is arranged on the insulator head.

That part is shown at 10 in FIG. 2, in contact with the zone 5 of the body 1 between the head 3 heated by the melted metal and the non-heated flat part. It is constituted by an annular metallic ring which can fulfill the function of a seal between the mold and the plate. It could be an advantage to constitute that ring with the same substance as that of the cap 4; thus, the melting mass will be locally cooled by heat conductivity from the melting mass to the mass of the ring, but also, occasionally, by the melting heat of the part of the ring 10 in contact with that melting mass, which part itself will have melted.

That arrangement is a particular advantage when the edge of the cap 4 comprises a toroidal reinforcing part, which involves an accumulation of localized heat input to be dissipated, as shown in FIG. 2.

When the ring 10 is constituted of the same material substance as the cap 4, it is an advantage to manufacture it, according to another aspect of the invention, in the same molding operation as that of the cap 4. In this situation, the mold must comprise, besides the molding volume corresponding to the cap 4, a molding volume corresponding to the ring 10, supplied by a molding connection orifice which is sufficiently thin for the separation of the ring 10 from the cap 4 to be effected easily. Thus, the molding of the ring 10 constituting the seal for a following molding operation may be effected at each molding operation for the cap 4. As the two operations are effected in an almost equivalent time (that is, the second following the first very closely), there is no danger of surface etching by oxidation, for example, disturbing a connection by melting of the two parts, the cap 4 and the ring 10.

Figure 3:
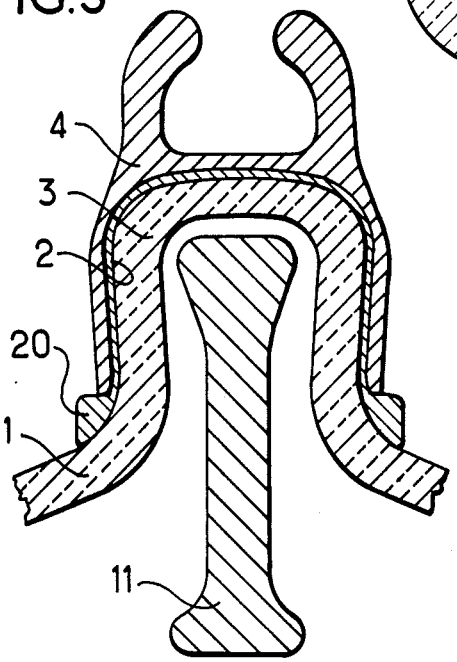
FIG. 3 shows an axial cross-section view of a cap and rod type insulator, in which the edge of the metallic sleeve is in the form of a flange.

It is possible to constitute the sleeve 2 in such a way that it comprises a flange 20, FIG. 3, which may act as a seal between the mold and the plate.

In these conditions, it may be useless to subject the sleeve 2, after insertion on the head 3, to an electromagnetic crimping operation; the crimping may be effected by the pressure molding operation itself.

Figure 5:
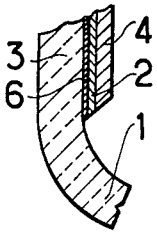
FIG. 5 is a fragmentary enlargement of a portion of FIG. 1.

In some instances, especially when the cast metal of the cap is very hot and the insulator head is of glass, there can occur at times a sticking of the inner side of the sleeve 2 onto the insulator head 3. This can be avoided by applying a thin layer 6 of a grease such as molybdenum disulfide-based grease on the inner side of the sleeve. (FIG. 5)

Figure 4:
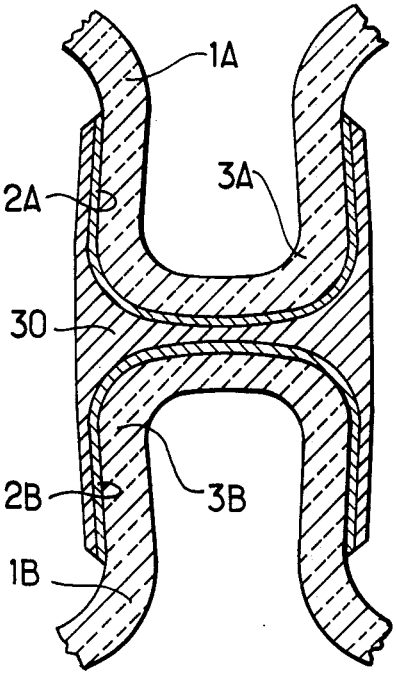
FIG. 4 shows an axial cross-section view of a cap and rod type insulator having two insulating plates connected together head to tail.

Although the preceding examples describe only the cap and rod type insulating means, it is quite evident that the method applies whatever the form and the destination of the connecting caps to be produced may be. Thus, in the field of insulators, it can be applied for producing a connecting cap for two insulating bodies connected up together head to tail as shown at 30 in FIG. 4. The two bodies 1A, 1B whose adherence heads 3A, 3B are each covered by their sleeves 2A, 2B, are arranged in a mold in two parts suitably stopped up at each end by appropriate seals. After molding, an insulating element assembled by the bush 30 is obtained.

Such a method may, to great advantage, be applied to the producing of insulators according to French Pat. No. 1,276,071 and addition 88,768, 1,276,072 and addition 88,769, 2,092,666, 2,088,172, 2,036,197, and 1,595,454. In these embodiments, instead of arranging a sleeve on each adherence head of the insulating bodies, it is evident that it is just as possible to use a single sleeve having an appropriate shape, cylindrical or profiled by the embossing method, for example.

It is quite evident also that the method described may be applied to the fixing of metallic connecting caps to any objects other than insulators whatever their form and destination may be.

Although the fixing methods and devices for a metallic connecting cap on a non-metallic part which have been described hereinabove may appear to be preferable, it will be understood that various modifications may be made thereto without going beyond the scope of the invention, it being possible to replace certain operations or certain parts by others which would fulfill the same technical function therein.

I claim:

1. A method of fixing a metallic connecting cap of an electrical insulator of the rod-and-cap type on a non-metallic dielectric part, said metallic connecting cap comprising a lower part to be fitted around the non-metallic dielectric part and an upper part containing a cavity for receiving the lower part of a rod, said method comprising the steps of:

(1) closely applying a first thin metallic part to at least a part of the outer surface of said non-metallic dielectric part on which said lower part of a first metallic connecting cap is to be fixed wherein said first metallic part provides good conduction of heat; then (2) molding said first metallic connecting cap on said first thin metallic part while the material of which said metallic connecting cap is to be composed is in the melted state, whereby said first metallic part reduces thermal shock to said non-metallic dielectric part by maintaining a moderate temperature gradient across said non-metallic dielectric part; while simultaneously (3) molding a second thin metallic part in the form of a ring; then (4) separating said second thin metallic part from said first metallic connecting cap; and then (5) closely applying said second thin metallic part to at least a part of the outer surface of a second non-metallic dielectric part on which a lower part of a second metallic connecting gap is to be fixed.

* * * * *